US006466909B1

(12) United States Patent
Didcock

(10) Patent No.: US 6,466,909 B1
(45) Date of Patent: Oct. 15, 2002

(54) SHARED TEXT-TO-SPEECH RESOURCE

(75) Inventor: Cliff Didcock, Wantage (GB)

(73) Assignee: Avaya Technology Corp., Baking Ridge, NJ (US)

( * ) Notice: Subject to any disclaimer, the term of this patent is extended or adjusted under 35 U.S.C. 154(b) by 0 days.

(21) Appl. No.: 09/340,552

(22) Filed: Jun. 28, 1999

(51) Int. Cl.[7] ..... G10L 13/08
(52) U.S. Cl. ..... 704/260; 704/258
(58) Field of Search ..... 704/260; 379/52, 379/88.16

(56) References Cited

U.S. PATENT DOCUMENTS 5,732,216 A * 3/1998 Logan et al. ..... 395/200.33
5,737,725 A * 4/1998 Case ..... 704/260
5,850,629 A * 12/1998 Holm et al. ..... 704/260
6,161,087 A * 12/2000 Wightman et al. ..... 704/215

FOREIGN PATENT DOCUMENTS

EP 0 944 004 A1 9/1999 ..... G06F/17/00

OTHER PUBLICATIONS

Abe et al, "A New Framework to Produce Multimedia Content by Combining Synthesized Speed and Moving Pictures in the WWW Environment", 1999, IEEE pp. 611–616.*

Wu et al, "Speech Activated Telephony Email Reader Based on Speaker Verification and TTS Conversion", IEEE, 1997, pp. 707–716.*

Delogu et al, "Spectral Analysis of Synthetic Speech and Natural Speech with Noise over the Telephone Line", IEEE, 1409–1412.*

"Accessing Messages Your Way," AT&T Technology, XP–000530274, 10(1995) spring, No. 1, New York, US, 2 pages.

"AOL & Microsoft Fight OVer Instant Messaging Contunues," XP–002188386, Jul. 26, 1999, 1 page.

* cited by examiner

*Primary Examiner*—Richemond Dorvil
*Assistant Examiner*—Michael N. Opsasnick
(74) *Attorney, Agent, or Firm*—Haverstock & Owens LLP

(57) ABSTRACT

An architecture is provided for sharing text-to-speech (TTS) resources. A TTS controller manages the allocation of the TTS resources. An application provides a conversion request which is provided to a first queue. An available TTS resource begins a conversion upon sentence boundaries and converts a predetermined minimum amount of text. Once a sufficient amount of text is converted, the digitized speech data is played to a user. The amount of converted data is monitored during the playback operation. As the totality of the converted data falls below a predetermined minimum the TTS controller is notified. If more text remains in a message being converted, the TTS controller places a request into a second queue. The second queue has a higher priority so that continuing conversions are completed before subsequent conversions begin. The user is able to cancel this conversion operation at any time. By cancelling this conversion operation, TTS resources are conserved by not unnecessarily converting the whole text message.

9 Claims, 4 Drawing Sheets

| Primary playback process | Background conversion process |
|---|---|
| 200 Receive convert request (inc. text)<br>210 Create shared file to store converted audio data<br>220 Initialize background convert operation using shared file<br>230 While (dataAvailible) AND (NOT CancelledByUser)<br>Playback audio from shared file | 240 Insert in InitializationRequestQ<br>250 Until ((AudioPointer - PlayPointer) > 'UnplayedInitializationHighThreshold) OR DONE)<br>Convert<br>260 Until ((AudioPointer - PlayPointer) < UnplayedLowThreshold) AND NOT DONE)<br>Pause<br>270 Insert in RestartRequestQ<br>280 Until ((AudioPointer - PlayPointer) > UnplayedHighThreshold) AND NOT DONE)<br>Convert<br>290 Goto 260<br><br>Note: DONE is true when all text is converted, or when playback is cancelled by the user. This state terminates the conversion process. |

| Primary playback process | Background conversion process |
| --- | --- |
| 200 Receive convert request (inc. text)<br>210 Create shared file to store converted audio data<br>220 Initialize background convert operation using shared file<br>230 While (dataAvailible) AND (NOT CancelledByUser)<br>Playback audio from shared file | 240 Insert in InitializationRequestQ<br>250 Until ((AudioPointer - PlayPointer) > 'UnplayedInitializationHighThreshold) OR DONE)<br>Convert<br>260 Until ((AudioPointer - PlayPointer) < UnplayedLowThreshold) AND NOT DONE)<br>Pause<br>270 Insert in RestartRequestQ<br>280 Until ((AudioPointer - PlayPointer) > UnplayedHighThreshold) AND NOT DONE)<br>Convert<br>290 Goto 260<br><br>Note: DONE is true when all text is converted, or when playback is cancelled by the user. This state terminates the conversion process. |

FIG._2

T2: Initial conversion pause (Unplayed initialization high threshold reached)

T3: Unplayed low threshold reached, conversion restarted

T4: Unplayed high threshold reached, conversion (re)paused

SHARED TEXT-TO-SPEECH RESOURCE

FIELD OF THE INVENTION

This invention relates to the field of text-to-speech conversion, especially in a voice messaging and communications setting. More particularly, this invention relates to a method of and apparatus for efficient sharing of a text-to-speech conversion resource in a unified messaging application.

BACKGROUND OF THE INVENTION

Increasing numbers of users are accessing e-mail messages. At its inception, a user necessarily could only review an e-mail message from their desktop, either from a terminal or personal computer (PC). Modem users require more freedom which prompted remote e-mail access, for example via a laptop computer and modem. More recently, users' desire for more efficient access to e-mail has prompted the introduction of voice delivered e-mail. In voice delivery, a machine or human operator reads the e-mail message directly from the caller's mailbox. The merging of text and voice messaging into a single delivery source is known in the art as Unified Messaging. This allows the recipients to retrieve their e-mail messages at any time they have access to a telephone. Owing to cellular and satellite telephony technology, such a system, in essence, allows users to access their e-mail at any time and from almost any place.

The machine conversion of an e-mail message to voice message utilizes a text-to-speech (TTS) conversion resource. Unified Messaging applications in addition to other applications which read text over the telephone, use a TTS conversion resource. As is well known in the art, TTS can be implemented in either host-based software or using separate voice processing hardware. In either form it should be considered as a 'scarce resource'. TTS is expensive in either throughput or hardware expenditures. In the host-based software implementation the CPU cycles associated with conversion limit the number of concurrent conversions which a single system can support. Using separate voice processing hardware incurs additional cost and consequently there is a need to operate with a limited number of resources.

Often users do not listen to long recitations of detailed e-mail messages. Rather, users will listen to a first part of the message then skip the remainder until they return to their PC or laptop computer and review the details of the e-mail message in text format. Converting such a message in its entirety would in essence be a wasteful use of a scarce resource.

For at least these reasons, it is desirable to perform TTS conversions on demand. In other words, the conversion is performed when the user is on the telephone and determines that they want to hear their e-mail messages. Unless there was a dedicated TTS resource for each user, the likelihood exists that a user would be required to wait an extended period of time for other users to complete the review of their e-mail messages so that the TTS resource will be available. Under certain circumstances, this delay could prevent the user from retrieving their e-mail messages until a later time.

What is needed is a more efficient method and apparatus for sharing a TTS resource.

What is further needed is an efficient just-in-time sharing of a TTS resource.

SUMMARY OF THE INVENTION

An architecture is provided for sharing text-to-speech (TTS) resources. A TTS controller manages the allocation of the TTS resources. An application provides a conversion request which is provided to a first queue. An available TTS resource begins a conversion upon sentence boundaries and converts a predetermined minimum amount of text. Once a sufficient amount of text is converted, the digitized speech data is played to a user. The amount of converted data is monitored during the playback operation. As the totality of the converted data falls below a predetermined minimum the TTS controller is notified. If more text remains in a message being converted, the TTS controller places a request into a second queue. The second queue has a higher priority so that continuing conversions are completed before subsequent conversions begin.

BRIEF DESCRIPTION OF THE DRAWINGS

FIG. 2 is a logic diagram of an embodiment of the present invention.

DETAILED DESCRIPTION OF THE PREFERRED EMBODIMENT

The preferred embodiment of the present invention is for a shared TTS resource in a Unified Messaging application. It will be apparent to one of ordinary skill in the art that the principles of the invention can be readily applied to a shared TTS resource in other applications (eg. an over-the-phone e-mail reading application.)

Figure 1:
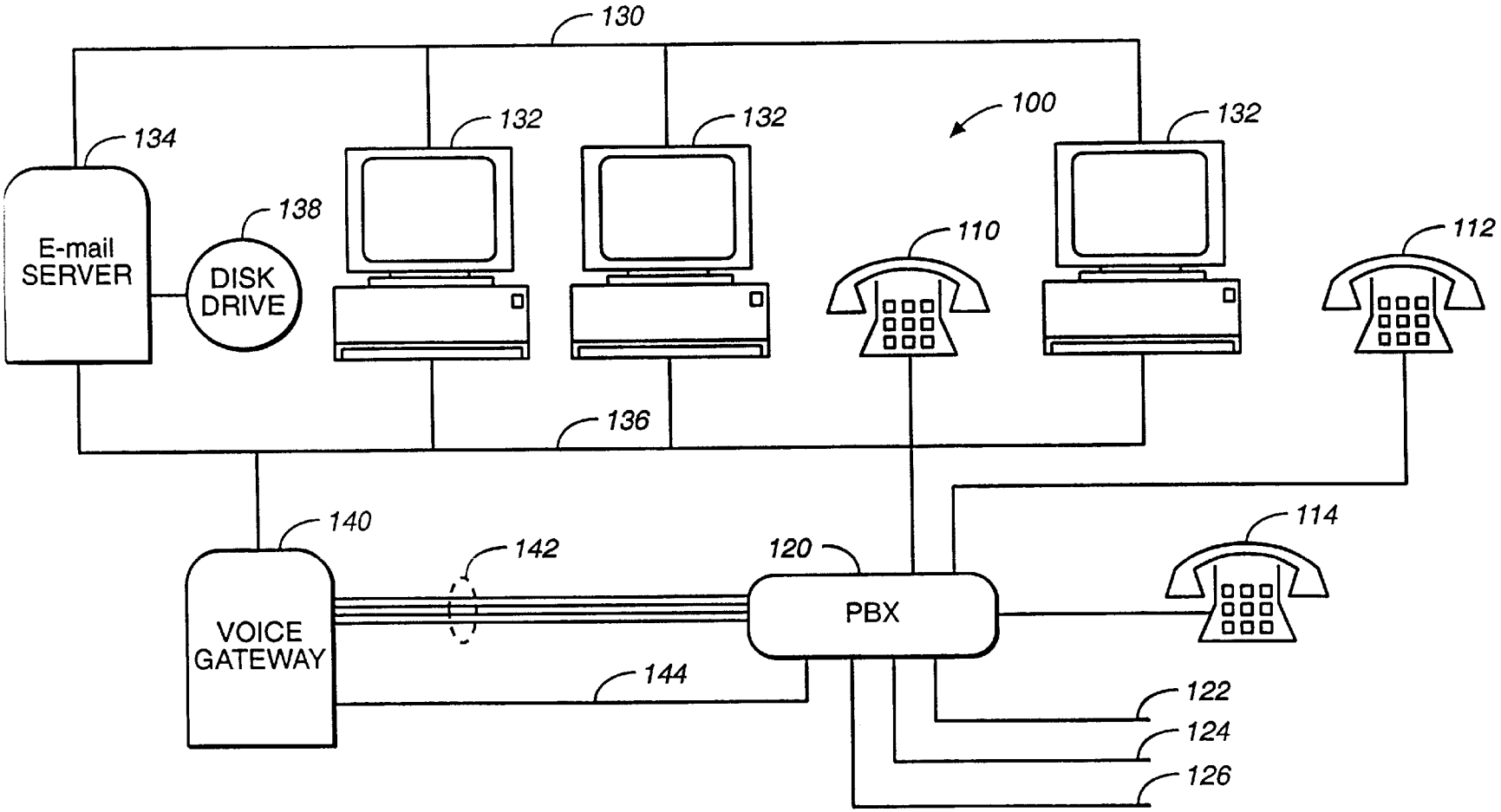
FIG. 1 is a block diagram of an embodiment of a unified messaging system constructed to take advantage of the present invention.

Referring now to FIG. 1, a block diagram of an embodiment of a unified messaging system 100 constructed to take advantage of the present invention is shown. The unified messaging system 100 comprises a set of telephones 110, 112, 114 coupled to a Private Branch Exchange (PBX) 120; a computer network 130 comprising a plurality of computers 132 coupled to an e-mail server 134 via a network line 136, where the e-mail server 134 is additionally coupled to a data storage device 138; and a voice gateway server 140 that is coupled to the network line 136, and coupled to the PBX 120 via a set of telephone lines 142 as well as an integration link 144. The PBX 120 is further coupled to a telephone network via a collection of trunks 122, 124, 126. The unified messaging system 100 shown in FIG. 1 is equivalent to that described in U.S. Pat. No. 5,557,659, entitled "Electronic Mail System Having Integrated Voice Messages," which is incorporated herein by reference. Those skilled in the art will recognize that the teachings of the present invention are applicable to essentially any unified or integrated messaging environment.

In the present invention, conventional software executing upon the computer network 130 provides file transfer services, group access to software applications, as well as an electronic mail (e-mail) system through which a computer user can transfer messages as well as message attachments between their computers 132 via the e-mail server 134. In an exemplary embodiment, Microsoft Exchange™ software (Microsoft Corporation, Redmond, Wash.) executes upon the computer network 130 to provide such functionally. Within the e-mail server 134, an e-mail directory associates each computer user's name with a message storage location, or "in-box," and a network address, in a manner that will be readily understood by those skilled in the art. The voice gateway server 140 facilitates the exchange of messages between the computer network 130 and a telephone system. Additionally, the voice gateway server 140 provides voice messaging service such as call answering, automated attendant, voice message store and forward, and message inquiry operations to voice messaging subscribers. In the preferred embodiment, each subscriber is a computer user identified in the e-mail directory, that is, having a computer 132 coupled to the network 130. Those skilled in the art will recognize that in an alternate embodiment, the voice messaging subscribers could be a subset of computer users. In yet another alternate embodiment, the computer users could be a subset of a larger pool of voice messaging subscribers, which might be useful when the voice gateway server is primarily used for call answering.

A TTS resource according to the present invention includes the following characteristics. The output of the conversion preformed by the TTS resource is digitized audio data which conforms to a known format. The digitized audio data can be played to the user, for example via an ordinary telephone handset. An example format is 64 kilobits per second PCM. According to experimentation and data taken over a variety of users, at normal reading rates text approximately 100 characters of text takes six seconds to read. Six seconds of digitized audio data is approximately 48 kilobytes of voice data. The preferred TTS resource converts text to speech at speeds faster than real-time. While the conversion process is CPU intensive, it generally occurs in approximately one tenth of the time it takes to read the text, depending on system specification and load.

Callers do not typically listen to the full duration of lengthy e-mail messages. Experience suggests messages are often skipped after 60 seconds or so. Thus, for a 'just-in-time' scheme for converting text to audio data, only the initial portions of an e-mail text message should be converted. The system will only continue with the conversion process thereafter if the user continues to listen. In the event the user hangs up or signals that the remainder of the message is not presently wanted, the system will not have wasted resources converting the remainder of the message. One way a user can signal to the system to stop TTS conversion is for example by pressing an appropriate key on the telephone number pad.

Continuing TTS conversion is given a higher priority than conversion of a new message. Preferably, the priority is established through the use of two queues. One queue contains application threads of execution wishing to start a conversion. The second, higher priority queue contains threads wishing to restart.

FIG. 2 shows a sequence chart for illustrating two parallel logic sequences of the present invention. The primary playback process is illustrated as steps 200 to 230. The background conversion process has an asynchronous nature and is illustrated as steps 240 to 290. The present invention interfaces with an Application, eg., a Unified Messaging system.

In operation, a conversion request and incoming text is received at the step 200. At the step 210, a shared file is created for storing converted audio data. Next, at the step 220, the background conversion process is invoked using the shared file. This shared file is capable of both storing the converted audio data and also simultaneously playing this converted audio data.

Next, the present invention utilizes an InitializationRequestQ in the step 240 which is an initial step in the asynchronous background conversion process. In the step 250, conversion of the text data into converted audible data continues until the difference between the audio pointer and the play pointer is greater than the UnplayedInitialisationHighThreshold. If all the text is converted or playback is terminated by the user, then this conversion also terminates. The present invention queues all initialization requests in an InitializationRequestQ queue. The initialization requests are serviced in the order they are received as a TTS resource becomes available. When the TTS resource becomes available it is allocated for exclusive use. Any initialization request that remains in the InitializationRequestQ queue for longer than a predetermined time MaximumInitWaitTime is rejected with an 'AllResourcesBusy' error and the application is so notified.

In the step 260, the present invention pauses the background conversion process until the difference between the audio pointer and the playback pointer is less than the UnplayedLowThreshold and when either some text is not converted and when playback is not cancelled by the user. When the conversion process is paused, the current position in the text pointer is saved. The TTS resource is released and returned to the TTS Resource Controller for subsequent reallocation.

In the step 270, the present invention utilizes a RestartRequestQ which is for restarting the conversion process after a pause as described above in the step 260. In the step 280, conversion of the text data into converted audible data continues until the difference between the audio pointer and the play pointer is greater than the UnplayedHighThreshold and when either some text is not converted or when playback is not cancelled by the user. The present invention queues this restart on a RestartRequestQ. Next, the process loops back to the step 260 where the conversion process is paused.

The RestartRequestQ queue is provided a higher priority than the InitializationRequestQ queue. In this way, once a TTS resource becomes available the present invention will service the next RestartRequestQ. Any conversions waiting in the InitializationRequestQ will be required to wait until all of the requests in the RestartRequestQ are serviced. The RestartRequestQ conversion is restarted, and continues converting text as before, on sentence boundaries, by sentence, and the output again stored in the output storage location.

It is possible that the restart will not be serviced (although this is unlikely if correctly configured) before all the converted data has been played back. In this case the request is removed from the RestartRequestQ and an error returned to the calling application.

Conversion is complete when either the caller indicates that he/she does not wish to hear any more converted audio, or all text supplied has been converted. If the user cancels the conversion operation, any in-process conversion operation is canceled, or any queued re-start request is de-queued.

An example is provided of a system that incorporates the teachings of the present invention and is shown in FIGS. 3A to 3F. This example merely shows a specific embodiment of the present invention and does not limit the scope of the present invention. It will be apparent to one of ordinary skill in the art that a system can be provide which supports more or fewer users and which includes more or fewer TTS resources and still follow the spirit and scope of the present invention. For the example system conversion happens at ten times the required playback speed. It will be apparent that the conversion speed is a function of the processor, the text data and system usage, among other factors.

The example system assumes the following values:

UnplayedIntitializationHighThreshold=240 kbytes (30 seconds of audio)

UnplayedHighThreshold=160 kbytes (20 seconds of audio)

UnplayedLowThreshold=80 kbytes (10 seconds audio)

Figure 3A:
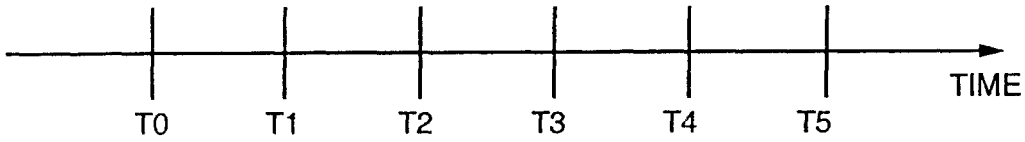
FIG. 3A is a time line of a sample operation of the present invention.
Figure 3B:
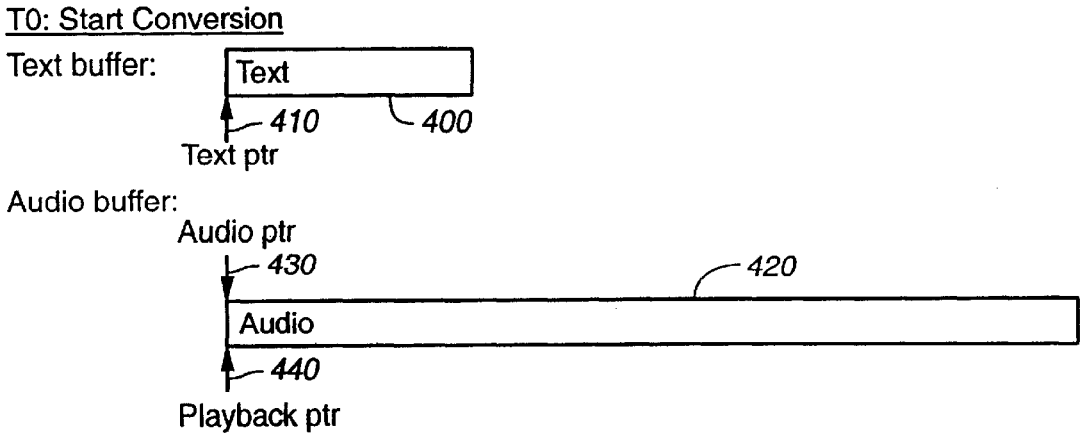
FIGS. 3B–3F are detailed diagrams showing specific steps of the sample operation shown on the time line in FIG. 3A.

FIG. 3A illustrates a timing diagram which shows a sample operation of the present invention. This example begins at T0 where conversion of the text message to a corresponding audio message is initiated. FIG. 3B illustrates the initiation of the conversion as described at T0 in FIG. 3A. A text buffer 400 illustrates a storage allocation for text data which corresponds to a text message. A text pointer 410 represents a present location of a pointer device relative to the text data within the text buffer 400. Preferably, text data located prior to the text pointer 410 (to the left of the text pointer 410 in FIG. 3B) has been read by the present invention, and text data located subsequent to the text pointer 410 (to the right of the text pointer 410 in FIG. 3B) has not been read by the present invention. As the text data is read from the text buffer 400, the text pointer 410 advances forward (graphically shown in FIG. 3B as toward the right of the audio pointer 410.)

An audio buffer 420 illustrates a storage allocation for audio data which corresponds to converted text data from the text buffer 400. The audio data is an audible representation of the text data. An audio pointer 430 represents a present location of a pointer device relative to the audio data within the audio buffer 420. Preferably, the audio data located prior to the audio pointer 430 (to the left of the audio pointer 430 in FIG. 3B) corresponds to audio data that has been written by the present invention and corresponds to the text data in the text buffer 400 prior to the text pointer 410. Preferably, the audio data located subsequent to the audio pointer 430 (to the right of the audio pointer 430 in FIG. 3B) corresponds to audio data which has not been written by the present invention and does not necessarily correspond to the text data in the text buffer 400. As the text data is converted from the text data within the text buffer 400 and written as audio data into the audio buffer 420, the audio pointer 430 advances forward (graphically shown in FIG. 3B as toward the right of the audio pointer 430.)

A playback pointer 440 represents a present location of a pointer device relative to the audio data within the audio buffer 420. Preferably, the audio data located prior to the playback pointer 440 (to the left of the playback pointer 440 in FIG. 3B) corresponds to audio data that has been audibly played to the listener by the present invention and corresponds to an audible representation of the textual data in the text buffer 400 prior to the text pointer 410. Preferably, the audio data located subsequent to the playback pointer 430 (to the right of the audio pointer 430 in FIG. 3B) corresponds to audio data which has not been played by the present invention and may correspond to an audible representation of the textual data in the text buffer 400, depending on the location of the audio pointer 430 relative to the playback pointer 440. As the audio data in the audio buffer 420 is audibly played back, the playback pointer 440 advances forward (graphically shown in FIG. 3B as toward the right.)

According to FIG. 3B, at the start of conversion at T0, the text pointer 410, the audio pointer 430 and the playback pointer 440 are all at their initial start positions. For example, the text pointer 410 is preferably located at a far leftmost position of the text buffer 400. Additionally, the audio pointer 430 and the playback pointer 440 are preferably located at a far leftmost position of the audio buffer 420.

Figure 3C:
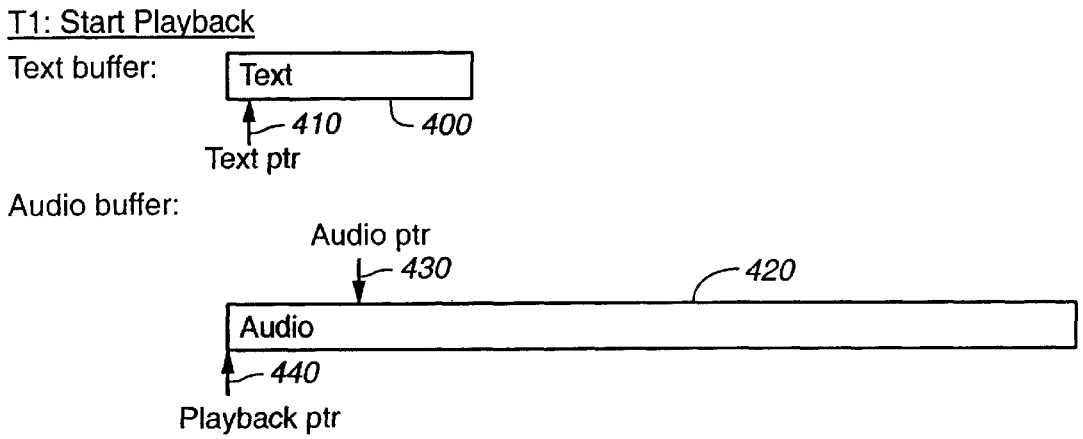

FIG. 3C illustrates the positions of the text pointer 410, the audio pointer 430 and the playback pointer 440 at T1 as shown in FIG. 3A. At T1, conversion of a portion of the text data within the text buffer 400 into the corresponding audio data within the audio buffer 420 is completed. At T1, the present invention is ready to start audio playback of the audio data within the audio buffer 420. As shown in FIG. 3C, the text pointer 410 has advanced towards the right within the text buffer 400 and indicates where the present invention stopped reading the text information within the text buffer 400. Further, the audio pointer 430 has also advanced towards the right within the audio buffer 420 and indicates the relative location within the audio buffer 420 where the audio data which corresponds to the text data has been written.

Figure 3D:
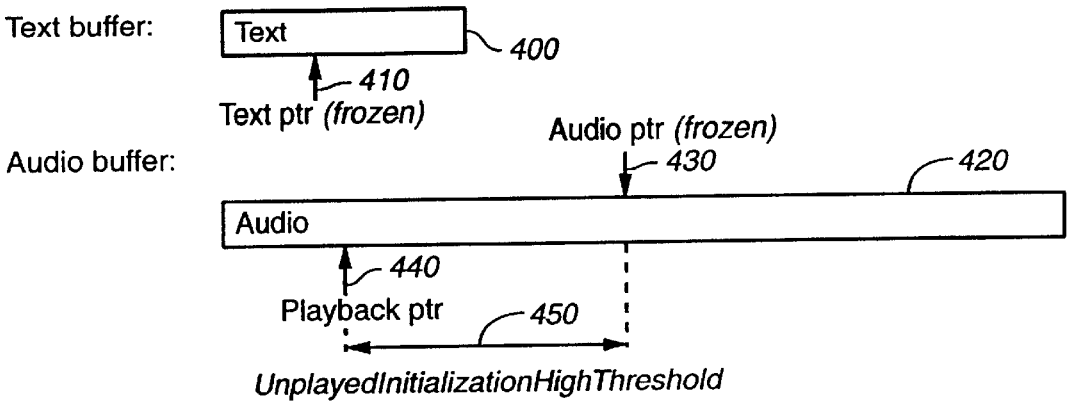

FIG. 3D illustrates the positions of the text pointer 410, the audio pointer 430 and the playback pointer 440 at T2 as shown in FIG. 3A. At T2, initial playback of the audio data within the audio buffer 420 is underway. The text pointer 410 has moved farther to the right within the text buffer 400 representing that an additional portion of the text data within the text buffer 400 has been read by the present invention. Similarly, the audio pointer 430 has also moved farther to the right within the audio buffer 420 representing that an additional portion of the audio data within the audio buffer 420 which corresponds to this additional portion of the text data being read. Having started playback of the audio data within the audio buffer 420, the playback pointer 440 has also moved towards the right within the audio buffer 420.

A threshold level 450 is measured by calculating the positional difference between the audio pointer 430 and the playback pointer 440. In this case, the threshold level 450 is classified as an UnplayedIntitializationHighThreshold. This signifies that the present invention currently has converted an adequate amount of text data from the text buffer 400 into audio data in the audio buffer 420. Preferably because of the threshold level 450, both the text pointer 410 and the audio pointer 430 are temporarily frozen which restricts the text data within the text buffer 420 from additional conversion into corresponding audio data.

Figure 3E:
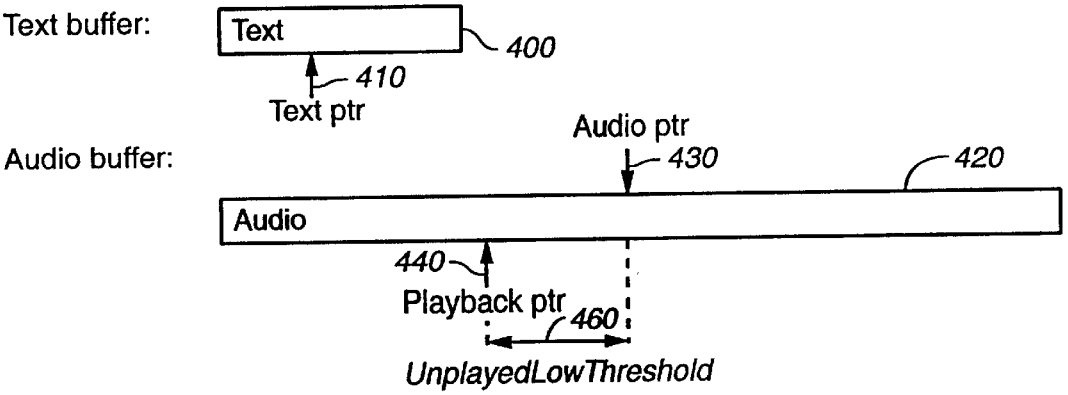

FIG. 3E illustrates the positions of the text pointer 410, the audio pointer 430 and the playback pointer 440 at T3 as shown in FIG. 3A. Similar to the threshold level 450, a threshold level 460 is measured by calculating the positional difference between the audio pointer 430 and the playback pointer 440. In this case, the threshold level 460 is classified as an UnplayedLowThreshold. This signifies that the present invention currently does not have an adequate amount of converted audio data in the audio buffer 420 which corresponds to the text data within the text buffer 400. Because of the threshold level 460, the text pointer 410 preferably advances towards the right of the text buffer 400 and read an additional portion of the text data. Similarly, the audio pointer 430 also advances towards the right of the audio buffer 420 and writes an additional portion of the audio data to the audio buffer 420. This additional portion of the audio data represents this additional portion of the text data.

Figure 3F:
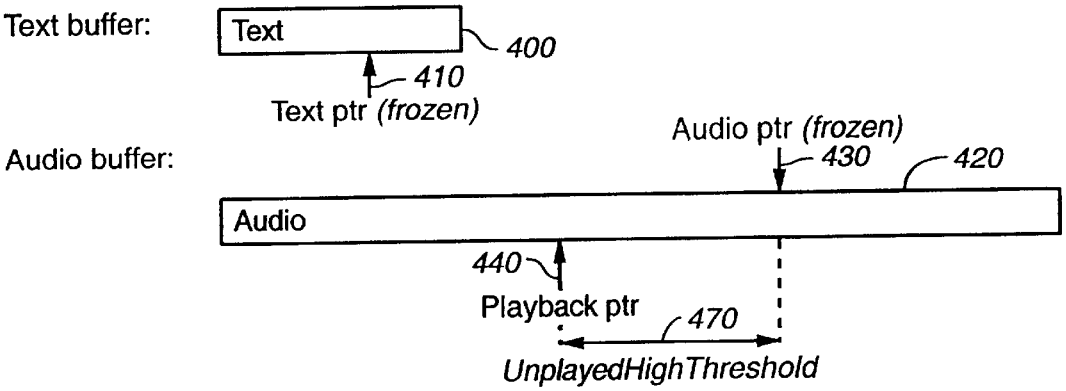

FIG. 3F illustrates the positions of the text pointer 410, the audio pointer 430 and the playback pointer 440 at T4 as shown in FIG. 3A. At T4, playback of the audio data within the audio buffer 420 is underway. The text pointer 410 has moved farther to the right within the text buffer 400 relative to the text pointer 410 at T3. By moving farther right, the text pointer 410 represents that an additional portion of the text data within the text buffer 400 has been read by the present invention. Similarly, the audio pointer 430 has also moved farther to the right within the audio buffer 420 relative to the audio pointer 430 at T3. By moving farther right, the audio pointer 430 represents that an additional portion of the audio data within the audio buffer 420 corresponds to this additional portion of the text data. Having continued playback of the audio data within the audio buffer 420, the playback pointer 440 has also moved towards the right within the audio buffer 420 relative to the playback pointer 440 at T3.

Similar to the threshold levels 450 and 460, a threshold level 470 is measured by calculating the positional difference between the audio pointer 430 and the playback pointer 440. In this case, the threshold level 470 is classified as an UnplayedHighThreshold. This signifies that the present invention currently has converted an adequate amount of text data from the text buffer 400 into audio data in the audio buffer 420. Preferably because of the threshold level 470, both the text pointer 410 and the audio pointer 430 are temporarily frozen which restricts converting additional text data from the text buffer 420 into corresponding audio data.

In this particular example, at T5 as shown in FIG. 3A, the user preferably cancels the playback of the written message. Accordingly, conversion of the remaining written message into audible data is immediately aborted and the present invention conserves TTS resources.

Unlike a conventional multi-tasking approach to resource management, the present invention takes into consideration that not all users will listen to the entirety of a message. Further, because the conversion rate is somewhat faster than real-time, and the text messages are parsed into grammatical units (sentences) the utilization of the system is better than a conventional multi-tasking system. The provision of a double queue providing higher priority to continuing conversion further enhances the efficiency of the system. Further, the present invention utilizes a shared storage device for simultaneously storing converted text data and audibly playing this converted text data.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device of the present invention could be implemented in several different ways and the apparatus disclosed above is only illustrative of the preferred embodiment of the invention and is in no way a limitation.

What is claimed is:

1. An architecture for managing a plurality of text-to-speech (TTS) resources, the TTS resources for converting text provided by an application for subsequent presentation as audio speech to a user, the architecture comprising:

a. TTS controller coupled to allocate the TTS resources, the TTS controller further coupled to receive a new conversion request from the application;

b. a first queue coupled to receive each new conversion request from the TTS controller;

c. a shareable storage element coupled to receive and for storing a converted message, wherein the shareable storage element is coupled for access to both the application and the TTS resource;

d. the TTS controller including means for determining when a TTS resource becomes available and for instructing an available TTS resource to convert the text message according to sentence boundaries; and e. a second queue coupled to receive a continuing conversion request, wherein the continuing conversion request has a higher priority that the new conversion request.

2. The architecture according to claim 1 further comprising means for determining an amount of unplayed converted data wherein a conversion operation ceases upon reaching a predetermined upper threshold of the amount of unplayed converted data.

3. The architecture according to claim 1 wherein the application is a unified messaging system.

4. The architecture according to claim 2 wherein a conversion operation will resume after the amount of unplayed converted data falls below a predetermined lower threshold of the amount of unplayed converted data.

5. A TTS controller coupled for managing a plurality of text-to-speech (TTS) resources, the TTS resources for converting text provided by an application for subsequent presentation as audio speech to a user, the TTS comprising:

a. means for determining whether a new conversion is required and for providing an indication in a first queue in response thereto;

b. means for determining whether a TTS resource is available, and for instructing a resource to initiate a conversion upon such a determination;

c. means for controlling the conversion to continue until at least a predetermined amount of text is converted, but for continuing until completion of a grammatical boundary;

d. means for stopping the conversion upon determining that the predetermined amount of text was converted, and for causing the application to playback a converted audio message;

e. means for determining whether a continuing conversion is required and for providing an indication to a second queue in response thereto, wherein an indication in the second queue has a higher priority than an indication in the first queue.

6. The architecture according to claim 5 further comprising means for determining an amount of unplayed converted data wherein a conversion operation ceases upon reaching a predetermined upper threshold of the amount of unplayed converted data.

7. The architecture according to claim 5 wherein the application is a unified messaging system.

8. The architecture according to claim 7 wherein a conversion operation will resume after the amount of unplayed converted data falls below a predetermined lower threshold of the amount of unplayed converted data.

9. A method of managing a plurality of text-to-speech (TTS) resources, the TTS resources for converting text provided by an application for subsequent presentation as audio speech to a user, the TTS comprising:

a. determining whether a new conversion is required and for providing an indication in a first queue in response thereto;

b. determining whether a TTS resource is available, and for instructing a resource to initiate a conversion upon such a determination;

c. controlling the conversion to continue until at least a predetermined amount of text is converted, but for continuing until completion of a grammatical boundary;

d. stopping the conversion upon determining that the predetermined amount of text was converted, and for causing the application to playback a converted audio message;

e. determining whether a continuing conversion is required and for providing an indication to a second queue in response thereto, wherein an indication in the second queue has a higher priority than an indication in the first queue.

* * * * *

UNITED STATES PATENT AND TRADEMARK OFFICE

CERTIFICATE OF CORRECTION

PATENT NO. : 6,466,909 B1
DATED : October 15, 2002
INVENTOR(S) : Cliff Didcock

It is certified that error appears in the above-identified patent and that said Letters Patent is hereby corrected as shown below:

Title page,
Item [73], Assignee, delete “Baking” and insert -- Basking --.

Signed and Sealed this

Eighteenth Day of February, 2003

JAMES E. ROGAN
*Director of the United States Patent and Trademark Office*